US007291189B2

(12) United States Patent
Lim et al.

(10) Patent No.: US 7,291,189 B2
(45) Date of Patent: Nov. 6, 2007

(54) DUST COLLECTING APPARATUS FOR VACUUM CLEANER

(75) Inventors: Jong-kook Lim, Gwangju (KR); Keon-soo Choi, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 414 days.

(21) Appl. No.: 10/991,057

(22) Filed: Nov. 17, 2004

(65) Prior Publication Data

US 2006/0000195 A1 Jan. 5, 2006

(30) Foreign Application Priority Data

Jul. 1, 2004 (KR) ..... 10-2004-0051066

(51) Int. Cl.
*B01D 45/12* (2006.01)
*B01D 50/00* (2006.01)

(52) U.S. Cl. ..... 55/337; 55/410; 55/418; 55/429; 55/433; 55/459.1; 55/482; 55/DIG. 3

(58) Field of Classification Search ..... 55/337, 55/410, 418, 429, 433, 482, 486, 459.1, DIG. 3; 15/350, 353
See application file for complete search history.

(56) References Cited

U.S. PATENT DOCUMENTS

| | | | |
|---|---|---|---|
| 4,790,865 | A | 12/1988 | DeMarco |
| 6,035,486 | A | 3/2000 | McCormick |
| 2004/0040270 | A1 | 3/2004 | Inoue et al. |

FOREIGN PATENT DOCUMENTS

| | | |
|---|---|---|
| CN | 1336154 | 2/2002 |
| DE | 2343971 | 4/1974 |
| DE | 10164279 | 4/2003 |
| DE | 10248087 | 4/2004 |
| GB | 2367484 | 4/2002 |
| GB | 2400309 | 10/2004 |
| JP | 2004135700 | 5/2004 |
| WO | WO01/50938 | 7/2001 |
| WO | WO84/02282 | 6/2004 |

OTHER PUBLICATIONS

Search Report from Spanish Patent Office, Feb. 20, 2007.

*Primary Examiner*—Robert A. Hopkins
(74) *Attorney, Agent, or Firm*—Ladas & Parry LLP

(57) ABSTRACT

A dust collecting apparatus for use in a vacuum cleaner provides improved suction cleaning efficiency. The dust collecting apparatus includes a main body comprising a suction port through which a dust-laden air is drawn, and a first and a second discharge ports through which filtered air is discharged. A filter unit disposed between the suction port and the first discharge port, filters out dusts from the air. A parallel cyclone unit, disposed between the suction port and the second discharge port, removes dusts from the air by centrifugal force. The first discharge port is larger in sectional area than the second discharge port, and therefore, the filter unit has higher dust removal rate than the cyclone unit in the initial stage of the operation. Accordingly, the dust collecting apparatus can provide greater initial suction cleaning efficiency than a dust collecting apparatus having only the cyclone unit.

18 Claims, 5 Drawing Sheets

DUST COLLECTING APPARATUS FOR VACUUM CLEANER

CROSS-REFERENCE TO RELATED APPLICATIONS

This application claims the benefit of Korean Patent Application No. 2004-51066 filed Jul. 1, 2004, in the Korean Intellectual Property Office, the disclosure of which is incorporated herein by reference.

FIELD OF THE INVENTION

The present invention relates generally to a dust collecting apparatus, and more particularly, to a cyclone type dust collecting apparatus for separating dust from air that is drawn into a vacuum cleaner.

BACKGROUND OF THE INVENTION

Vacuum cleaners generally collect dust using either a filter type dust collecting apparatus, which has limited lifespan, or a cyclone type dust collecting apparatus, which is usable almost permanently. A cyclone type dust collecting apparatus is more economical and hygienic than filter type. They are therefore, more popular.

A problem with cyclone type dust collecting apparatus is that they require a relatively long fluid passage to generate a cyclonic air flow. They thereforehave lower compression. Less compression leads to lower suction force of the vacuum cleaner. Accordingly, a cyclone type dust collecting apparatus with an improved compression would be an improvement over the prior art.

SUMMARY OF THE INVENTION

The present invention has been developed in order to solve the above drawbacks and other problems associated with the conventional arrangement. An aspect of the present invention is to provide a dust collecting apparatus for use in a vacuum cleaner, which provides improved suction force by increasing suction force.

The above aspects and/or other features of the present invention can substantially be achieved by providing a dust collecting apparatus for use in a vacuum cleaner, comprising a main body having a suction port through which dust-laden air is drawn and from which, air-laden dust is routed to two different filters that operate in parallel. A first filter unit, disposed between a suction port and a first discharge port, filters dust from the air. A second filter unit, embodied as a cyclone filter unit, is disposed between the suction port and the second discharge port and removes dust from the air by centrifugal force.

According to one aspect of the present invention, the first discharge port is larger in cross-sectional area than the second discharge port such that the filter unit removes a larger amount of dusts for a predetermined initial period of the operation. Accordingly, the dust collecting apparatus can provide greater initial suction cleaning efficiency than a dust collecting apparatus having only the cyclone unit or only a filter. The overall suction cleaning efficiency is therefore improved.

The filter unit comprises a filter disposed at the first discharge port, and a filter dust collecting part provided inside the main body of the dust collecting apparatus, to collect dusts separated from the air by the filter. The amount of dust removal by the cyclone unit increases at the time that the filter is blocked by the dusts. When the filter is completely blocked by the dusts, the dusts are cleaned by the cyclone unit.

The cyclone unit comprises a cyclone body having an air inlet connected with the suction port, and a dust outlet, the cyclone body forming a whirling air current with the air flowing in through the air inlet. A grill disposed at the second discharge port, and a cyclone dust collecting part provided inside the main body, collect dusts separated from the air by the centrifugal force and discharged through the dust outlet.

The air inlet of the cyclone filter is formed substantially tangentially with respect to the inner circumference of the cyclone body such that the air can be turned into a whirling air current when entering into the cyclone body.

The main body of the dust collecting apparatus comprises an opening for the disposal of dusts of the filter dust collecting part and the cyclone dust collecting part, and a door member for selectively opening the opening.

The door member may be movably engaged to one side of the main body of the dust collecting apparatus by a hinge.

Accordingly, a filter unit, which has stronger suction force at the initial stage of the operation removes most of the dusts, and then the cyclone unit remove most of the dust as the operation continues. Compared to the dust collecting apparatus having the cyclone unit only, the dust collecting apparatus according to the present invention can provide stronger suction force at the initial stage of the operation.

According to another aspect of the present invention, a dust collecting apparatus for use in a vacuum cleaner, comprises a main body comprising a suction port through which a dust-laden air is drawn, and a first and a second discharge ports through which dust-free air is discharged, a filter unit disposed between the suction port and the first discharge port, to filter out dusts from the air, a cyclone unit disposed between the suction port and the second discharge port, to remove dusts from the air by centrifugal force, and a minute dust filter disposed at the downstream of the first and the second discharge ports of the main body.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Figure 1:
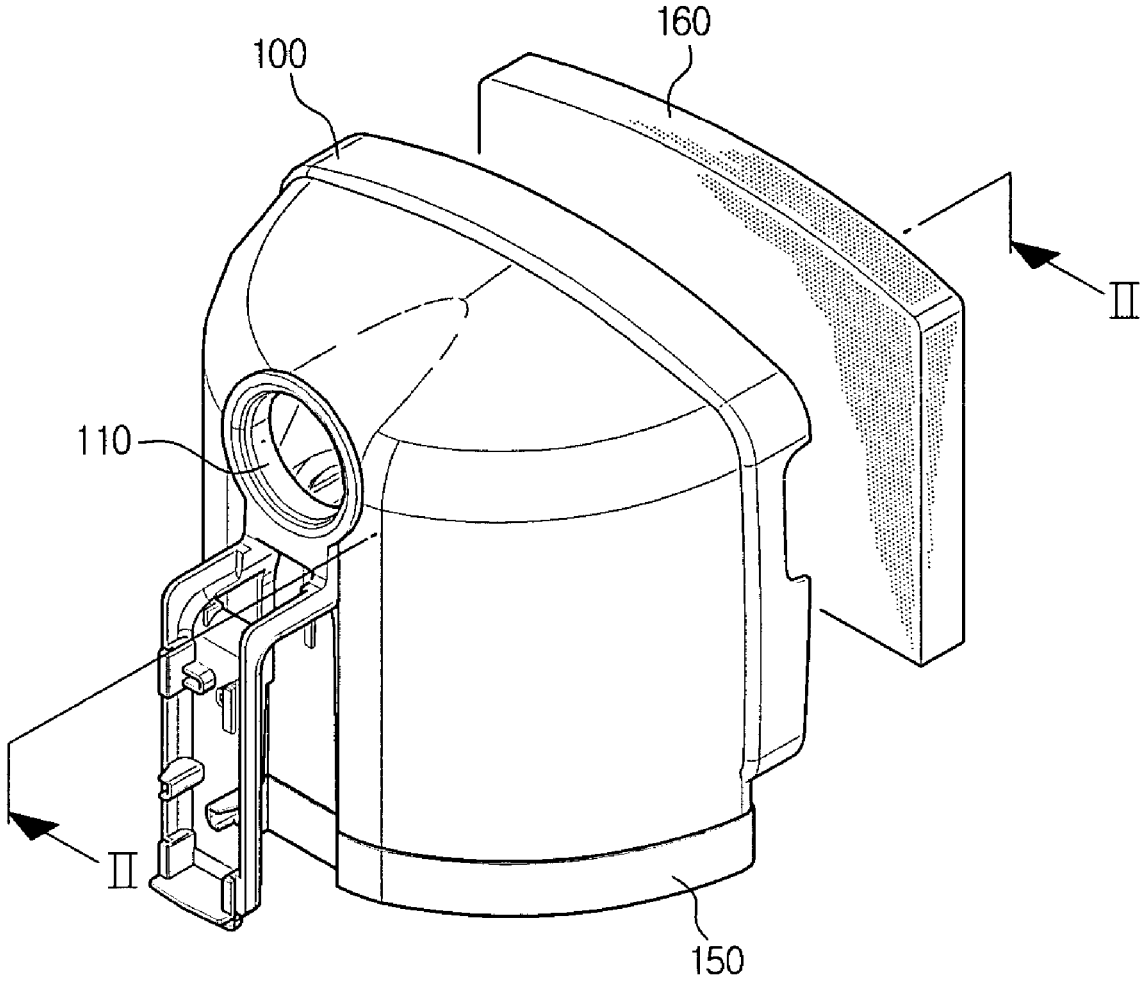
FIG. 1 is a perspective view illustrating a minute dust filter prior to assembling with a dust collecting apparatus for use in a vacuum cleaner according to an embodiment of the present invention.

Certain embodiments of the present invention will be described in greater detail with reference to the accompanying drawings.

In the following description, drawing reference numerals are used for the same elements even in different drawings. The detailed construction and elements described herein are provided as examples to assist in a comprehensive understanding of the invention claimed in the appurtenant claim.

Well-known functions or constructions are not described in detail since they would tend to obscure the invention that is disclosed and claimed in the appurtenant claims, in unnecessary detail.

As shown in FIGS. 1 through 6, a dust collecting apparatus for use in a vacuum cleaner according to one certain embodiment of the present invention includes a main body 100, a filter unit 130 and a cyclone unit 140.

Figure 2:
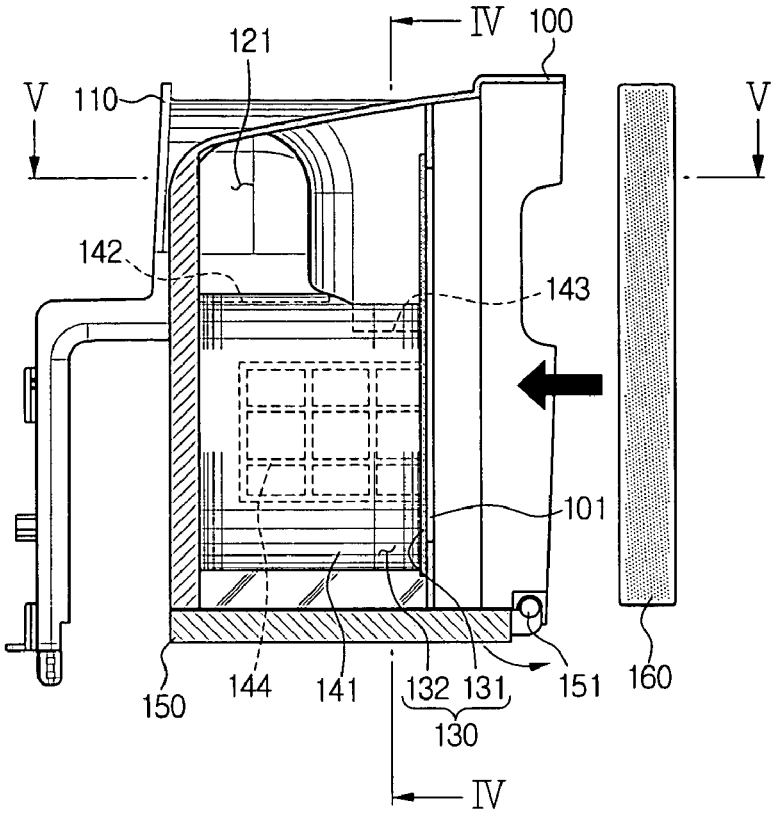
FIG. 2 is a sectional view taken on line II-II of FIG. 1.
Figure 3:
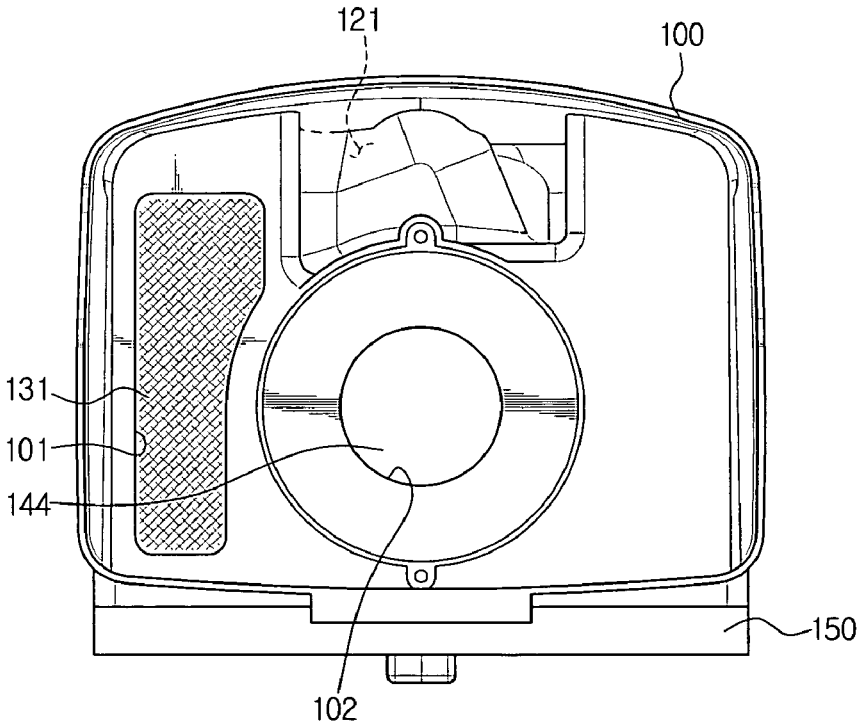
FIG. 3 is a rear view of FIG. 1.
Figure 5:
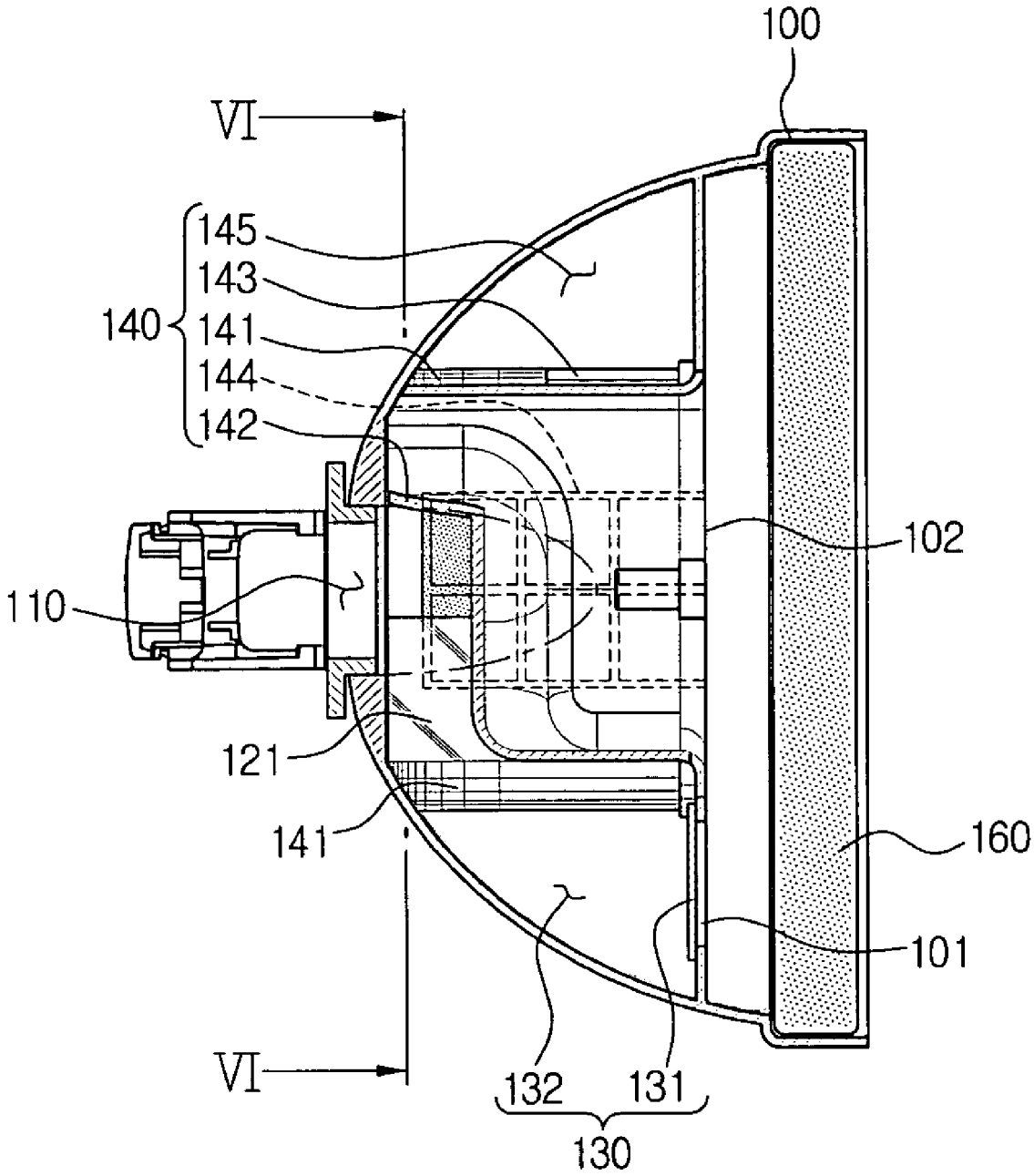
FIG. 5 is a sectional view taken on line V-V of FIG. 2.

The main body 100 of the dust collecting apparatus includes a suction port 110 as shown in FIG. 1 and a first and a second discharge ports 101 and 102 as shown in FIGS. 2, 3 and 5. A suction brush (not shown), is connected in the suction port 110, and moves along a surface being cleaned, drawing in dust and air therethrough. The air drawn in through the suction port 110 passes through the first and the second discharge ports 101 and 102, and is discharged from the main body 100. A filter unit 130 is disposed between the suction port 110 and the first discharge port 101. A cyclone unit 140 is disposed between the suction port 110 and the second discharge port 102. The filter unit 130 and the cyclone unit 140 filter dusts from the air entering the suction port 110. The filter unit 130 includes a filter element 131 and a filter dust collecting part 132.

A filter element 131 is disposed at the first discharge port 101, filtering out dusts from the air. As a result, filtered air is discharged from the main body 100.

As shown in FIGS. 2 and 5, the filter dust collecting part 132 is connected with the suction port 110 and a first fluid passage 121. The first fluid passage 121 is defined inside the main body 100 of the dust collecting apparatus, and supplies the air from the suction port 110 to the filter unit 130. The first discharge port 101 is formed at one sidewall of the filter dust collecting part 132 such that the air from the first fluid passage 121 can be discharged out of the dust collecting apparatus. As a result, dusts can be separated from the air by the filter 131, and the cleaned air is discharged out of the main body 100 of the dust collecting apparatus via the first discharge port 101, and the dusts are collected in the filter dust collecting part 132.

Figure 4:
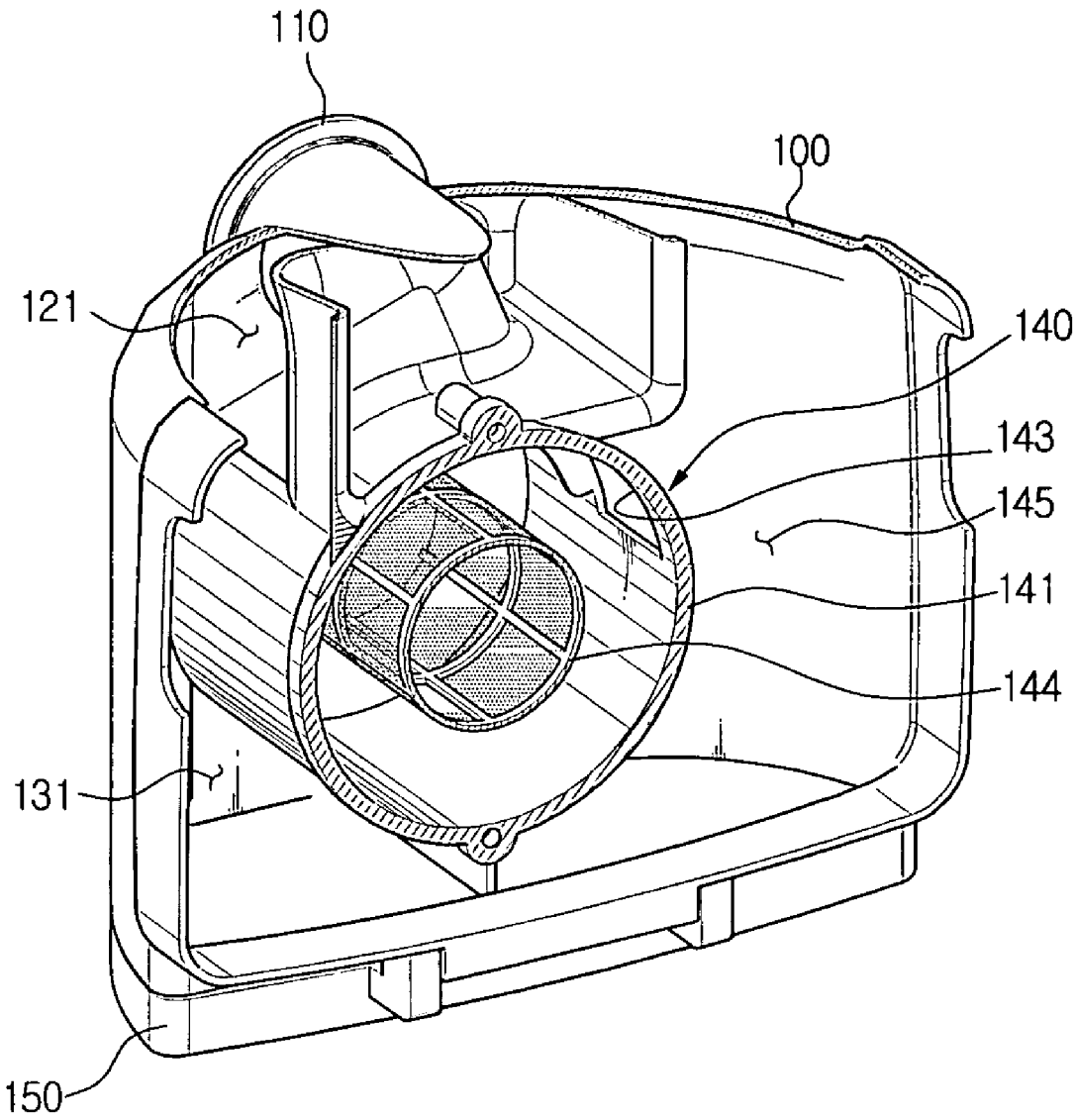
FIG. 4 is a perspective view illustrating the rear side of FIG. 1.

As shown in FIGS. 2 and 4, the cyclone unit 140 includes a cyclone body 141, a grill 144 and a cyclone dust collecting part 145. The cyclone body 141 includes an air inlet 142 connected with the suction port 110 and a dust outlet 143 from which a cyclone air current exits.

The cyclone body 141 is configured as a transverse cylinder, one end of which is connected to the suction port 110 via a second fluid passage 122. The second fluid passage 122 is connected with the air inlet 142 of the cyclone body 141, and therefore, transfers the drawn air into the cyclone body 141.

Figure 6:
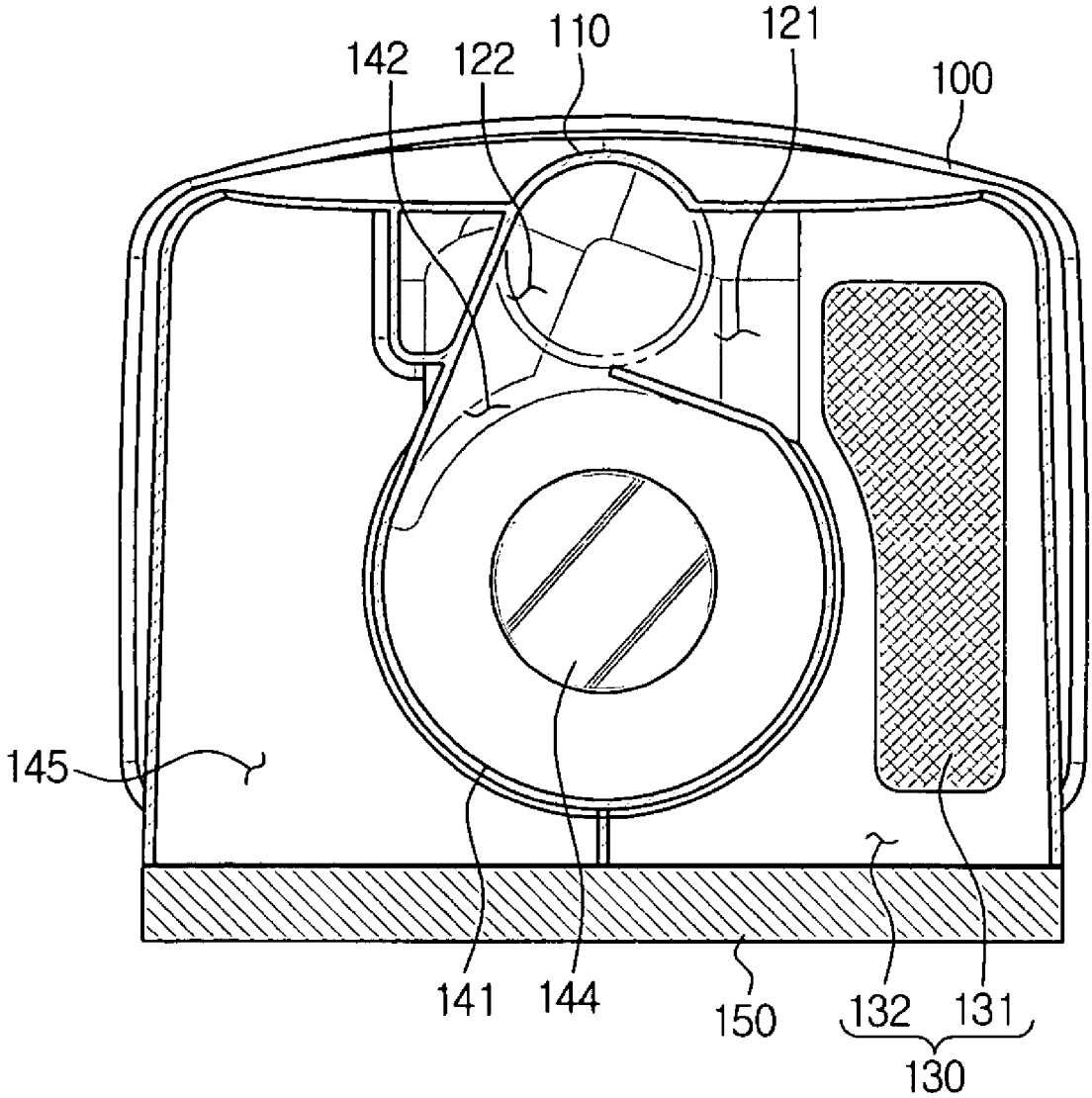
FIG. 6 is a sectional view taken on line VI-VI of FIG. 5.

Referring to FIG. 6, the air inlet 142 is formed tangentially with respect to the inner circumference of the cyclone body 141 so that the air from the suction port 110 and the second fluid passage 122 will rotate or curl inside the cyclone body 141, producing a cyclone effect that will induce centrifugal force on particles suspended in the air current.

Centrifugal force of the cyclone air current in the cyclone body 141, separates dusts in the cyclonic air current and are discharged out of the cyclone body 141 into the cyclone dust collecting part 145 through the dust outlet 143. To facilitate removal of dusts by centrifugal force of the whirling air current, the dust outlet 143 may be formed at the proximity of the second discharge port 102 which is distanced away from the air inlet 142 (FIGS. 2 and 4).

A grill 144 is disposed at the second discharge port 102, to prevent discharge of dusts from the cyclone body 141 through the second discharge port 102. As shown in FIGS. 2 through 4, the grill 144 may be an open-meshed netlike member which is disposed on the outer circumference of the cylinder.

The cyclone dust collecting part 145 is disposed in the space defined in the main body 100 of the dust collecting apparatus, together with a filter dust collecting part 132. The cyclone dust collecting part 145 fluidly communicates with the dust outlet 143 of the cyclone body 141 so that the separate dusts of the cyclone body 141 can be collected in the cyclone dust collecting part 145.

As shown in FIGS. 2 and 3, the first and the second discharge ports 101 and 102 are preferably disposed in the same plane. The first discharge port 101 may be larger in cross-sectional area than the second discharge port 102.

An opening can be formed in the bottom of the main body 100 of the dust collecting apparatus to discharge dusts that are separated by the filter dust collecting part 132 and the cyclone dust collecting part 145. As shown in FIG. 2, the opening in the bottom of the main body 100 is selectively opened by a movable door 150. As shown, the door 150 can be opened to discharge collected dust by way of a hinge 151. A slidably openable door may also be used instead of a hinged door.

According to another embodiment of the present invention, a minute dust filter 160 may be disposed downstream of the first and the second discharge ports 101 and 102, to secondly filter the air that might be laden with minute dust particles. The minute dust filter 160 can be embodied as a porous member such as a sponge, or a non-woven fabric such as the one generally used as the air filter.

In operation, a vacuum cleaner using the present invention provides a suction force, which is generated by a vacuum suction device not shown, but well known to those of ordinary skill. When the vacuum suction device produces a vacuum, dust-laden air is drawn in through the suction port 110.

The air drawn in passes through the separate first and the second fluid passages 121 and 122, and flows into the filter unit 130 and the cyclone unit 140 in parallel. According to one aspect of the present invention, more air flows into the filter unit 130 than into the cyclone filter unit 140 at the initial stage of operation. As a result, most dusts are removed by the filter unit 130.

As described above, the filter unit 130 performs most of the dust-cleaning at the initial stage of the operation because the first discharge port 101 is larger in sectional area than the second discharge port 202. In other words, since the first discharge port 101 has a larger sectional area that that of the second discharge port 102, more air passes through the first discharge port 101 than the second discharge port 102. As a result, at the beginning of the dust collecting process, the filter unit 130 has more air passing therethrough, than the cyclone unit 140.

As the filter unit 130 removes dusts, the air flowing through it decreases, reducing the amount of dust removed by the filter unit 130. Thereafter the cyclone unit 140 removes an increasing amount of dust.

Over time, the cyclone unit 140 will develop a stable cyclone air current by which it can provide a constant suction force. When this happens, the filter unit 130 has a degraded suction force due to dusts it collected. Accordingly, the air discharge to the filter unit 130 decreases, while the cyclone unit 140 has an increasing amount of air and remove increasing amount of dusts.

Air flows into the cyclone unit 140, through the air inlet 142 and is moved along the inner circumference of the cyclone body 141, forming a whirling air current. The whirling air current moves toward the second discharge port 102, and in so doing, dusts are separated from the air due to the centrifugal force imported to them by the whirling air current. The centrifugally-cleaned air is secondly filtered through the grill 144, and then discharged out of the dust collecting apparatus through the second discharge port 102.

With the dust collecting apparatus constructed as above according to the present invention, most dusts are filtered by the filter unit 130 at the initial stage of the cleaning. Initial suction force is therefore greater than using only one cyclone unit. Accordingly, overall suction cleaning efficiency of the dust collecting apparatus greatly improves.

As described above, the filter dust collecting part 132 and the cyclone dust collecting part 145 can be emptied simply by opening the hinged door member 150 as shown in FIG. 2 open.

Air that is cleaned using the foregoing structure and method can be further cleaned air by the aforementioned minute dust filter 160. As a result, even the minute dusts which are not filtered by the filter unit 130 and the cyclone unit 140, can be filtered again by the minute dust filter 160.

Using the foregoing exemplary embodiments of the present invention, a filter unit is provided that has strong suction force and which removes most dusts at the initial stage of the operation. Greater initial suction cleaning efficiency can therefore be provided.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A dust collecting apparatus for use in a vacuum cleaner, comprising:

a main body having a suction port through which air is drawn, and having a first and second discharge ports through which filtered air is discharged;

a first filter unit disposed between the suction port and the first discharge port, to filter out dust from the air; and a cyclone filter unit disposed between the suction port and the second discharge port, to remove dust from the air by centrifugal force.

2. The dust collecting apparatus of claim 1, wherein the first discharge port is larger in cross-sectional area than the second discharge port.

3. The dust collecting apparatus of claim 2, wherein the filter unit comprises:

a dust filter disposed at the first discharge port.

4. The dust collecting apparatus of claim 3, wherein the cyclone unit comprises:

a cyclone body having an air inlet connected with the suction port and, a dust outlet, the cyclone body form a cyclonic air current from air flowing through the air inlet.

5. The dust collecting apparatus of claim 4, further comprised of a grill disposed at the second discharge port.

6. The dust collecting apparatus of claim 4, further comprised of a cyclone dust collecting part provided inside the main body, to collect dusts separated from the air by the centrifugal force and discharged through the dust outlet.

7. The dust collecting apparatus of claim 4, wherein the air inlet is formed substantially tangentially with respect to the inner circumference of the cyclone body.

8. The dust collecting apparatus of claim 4, wherein the main body of the dust collecting apparatus comprises an opening for the disposal of dusts of the filter dust collecting part and the cyclone dust collecting part, and a door member for selectively opening the opening.

9. The dust collecting apparatus of claim 8, wherein the door member is movably engaged to one side of the main body of the dust collecting apparatus by a hinge.

10. A vacuum cleaner, comprising:

a dust collecting apparatus comprised of:

a main body having a suction port through which air is drawn, and a first and a second discharge ports through which filtered air is discharged;

a filter unit disposed between the suction port and the first discharge port, to filter the air;

a cyclone unit disposed between the suction port and the second discharge port, to remove dust from die air by centrifugal force; and a minute dust filter disposed at the downstream of the first and the second discharge ports of the main body.

11. The vacuum cleaner of claim 10, wherein the first discharge port is larger in sectional area than the second discharge port.

12. The vacuum cleaner of claim 10, wherein the filter unit comprises:

a filter disposed at the first discharge port; and a filter dust collecting part provided inside the main body of the dust collecting apparatus, to collect dust separated from the air by the filter, wherein the amount of dust removal by the cyclone unit increases at the time that the filter is blocked by the dusts.

13. The vacuum cleaner of claim 10, wherein the cyclone unit comprises:

a cyclone body having an air inlet connected with the suction port, and a dust outlet, the cyclone body forming a whirling air current with the air flowing in through the air inlet.

14. The vacuum cleaner of claim 12, further comprised of: a grill disposed at the second discharge port.

15. The vacuum cleaner of claim 12, further comprised of: a cyclone dust collecting part provided inside the main body, to collect dusts separated from the air by die centrifugal force and discharged through the dust outlet.

16. The vacuum cleaner of claim 12, further comprised of: a dust collecting apparatus of claim 12, wherein the air inlet is formed substantially tangentially with respect to the inner circumference of the cyclone body.

17. The vacuum cleaner of claim 12, wherein the main body of the dust collecting apparatus comprises an opening for the disposal of dusts of the filter dust collecting part and the cyclone dust collecting part, and a door member for selectively opening the opening.

18. The vacuum cleaner of claim 16, wherein the door member is movably engaged to one side of the main body of the dust collecting apparatus by a hinge.

* * * * *